United States Patent [19]

Salvagnini

[11] Patent Number: 4,843,862

[45] Date of Patent: Jul. 4, 1989

[54] BENDING MACHINE FOR SHEET METAL PANELS HAVING A BLANK HOLDER WITH UNIFORM COMPRESSION

[75] Inventor: Guido Salvagnini, Sarego, Italy

[73] Assignee: Salvagnini Transferica S.p.A., Sarego, Italy

[21] Appl. No.: 200,897

[22] Filed: Jun. 1, 1988

[30] Foreign Application Priority Data

Jun. 3, 1987 [IT] Italy ..... 20765 A/87

[51] Int. Cl.[4] ..... B21D 5/04

[52] U.S. Cl. ..... 72/319; 72/323

[58] Field of Search ..... 72/319–323, 72/316

[56] References Cited

U.S. PATENT DOCUMENTS

| | | | |
|---|---|---|---|
| 2,283,012 | 5/1942 | Nightingale | 72/319 |
| 2,343,441 | 3/1944 | Babcock et al. | 72/319 |
| 2,494,149 | 1/1950 | Webb | 72/319 |
| 3,946,588 | 3/1976 | Mayston | 72/319 |

FOREIGN PATENT DOCUMENTS

| | | | |
|---|---|---|---|
| 38263 | 10/1978 | Japan | 72/322 |
| 206525 | 9/1986 | Japan | 72/320 |

*Primary Examiner*—Daniel C. Crane

*Attorney, Agent, or Firm*—Cushman, Darby & Cushman

[57] ABSTRACT

The bending machine has a blank holder with a support hinged on a fixed base. The blank holder is operated by a plurality of hydraulic cylinders which act from the bottom up, reacting on the fixed base. The machine has opposite blades operated by horizontal and vertical cylinders, whose ends are hinged on the fixed base. Said opposite blades are held by a common support through which pass the stems of said hydraulic cylinders operating the blank holder. Said hydraulic cylinders are also equipped with a stoppage system for stopping the blank holder in a position above a sheet metal panel placed over a fixed counterblade.

6 Claims, 3 Drawing Sheets

BENDING MACHINE FOR SHEET METAL PANELS HAVING A BLANK HOLDER WITH UNIFORM COMPRESSION

BACKGROUND OF THE INVENTION

The present invention relates to a bending machine for sheet metal panels having a blank holder with uniform compression.

Several bending machines are known which have a fixed counterblade on which a sheet metal panel is positioned for bending. The latter is held by a blank holder while a blade consisting of a pair of counterblades executes the required bend of the edge of said sheet metal panel.

An example of such a bending machine is described in the Austrian Pat. No. 372883 in the name of Voest Alpine Aktiengesellschaft.

In such a bending machine a blank holder slides in lateral guides which are integral with the base of the machine to rise up and come down on a sheet metal panel positioned on a fixed counterblade. The blank holder is operated from above by hydraulic cylinders placed at its ends and is integral with arc-shaped supporting arms, on which actuators for moving the two blades are hinged.

The fixed counterblade is in its turn integral with the fixed base of the machine, on which additional actuators for moving the blades are hinged.

The greatest drawback which occurs in a bending machine of this type is that the forces which urge the blank holder upwards during the bending operation are not uniformly distributed in the direction of the line of bending but are concentrated more or less along the centre line of the machine according to the length of the bend to be executed and to the thickness of the sheet metal panel itself. It follows that the distance between the active edge of the blank holder and the underlying counterblade is greater in the centre than at the outer ends, so that, since the bending line follows the line of the blank holder's active edge, the bend is not straight. For the same reason it is not possible to make a so-called "safe hands" uncrushed U-shaped bend, because the distance between the superimposed edges would be less at the ends than at the centre.

The problem is certainly not solved by the two cylinders which press the blank holder downwards. Since the two cylinders are at the ends of the blank holder, they are not in a position to generate uniformly distributed forces, except with a hypothetical infinitely rigid blank holder. In fact, if the sheet metal to be bent is short and of substantial thickness, such a drawback is heightened; the blank holder actually tends to bend inwards by pivoting on the edges of the sheet metal, so that the central part of the blank holder rises up and assumes a concave configuration.

To overcome this drawback it is possible to exert pressure on the blank holder with a multiplicity of hydraulic cylinders uniformly distributed on the upper part of the machine, so as to counteract the force which tends to bend it, but this solution is of little advantage since it increases both cost and weight of the known bending machine and also makes its structure more complicated.

SUMMARY OF THE INVENTION

In view of this state of the art, the object of the present invention is to accomplish a bending machine for sheet metal panels in which the blank holder is not bent inwards, more precisely it is required that said blank holder exert on a sheet of metal to be bent in any required size a uniformly distributed pressure without increasing the weight of the bending machine or complicating its structure.

According to the invention, such object is attained by a bending machine for sheet metal panels consisting of a base with a counterblade, a movable blank holder, a pair of opposite blades, means for operating said pair of blades, characterized in that said blank holder has a support hinged on the fixed base and operated by a plurality of hydraulic cylinders which are distributed along a line that is parallel to the longitudinal direction of the blank holder and which act upwards on said support.

This solution induces a movement of the blank holder that is accurately parallel, ensured by its being hinged on a rigid object such as the base of the machine, while the different cylinders distribute the closing force of the blank holder in the most appropriate manner without causing any complication in the machine's structure.

Said opposite blades are preferably fixed to a single support with vertical openings for the passage of the stems of the hydraulic cylinders which operate the blank holder.

Said support is connected to the operating cylinders of said opposite blades, which react on the fixed base. In this way the inclination of the horizontal cylinders remains independent of the sheet metal's hickness.

Working together with said horizontal cylinders are support levers which are connected by a torsion bar common to all the cylinders. A mechanically parallel movement of the blank holder support is thus ensured.

Means are also provided to obtain the stoppage of the blank holder in a predetermined position so that so-called "safe hands" uncrushed U-shaped bends are produced on the edges of the sheet metal panels. Said means are preferably constituted by wedges which cooperate with said hydraulic cylinders which operate the blank holder so as to adjust the stoppage point of the downward stroke of the blank holder itself.

BRIEF DESCRIPTION OF THE DRAWINGS

One possible embodiment of the present invention is illustrated as a non-limiting example in the enclosed drawings, in which.

DETAILED DESCRIPTION OF THE PREFERRED EMBODIMENT

Figure 1:
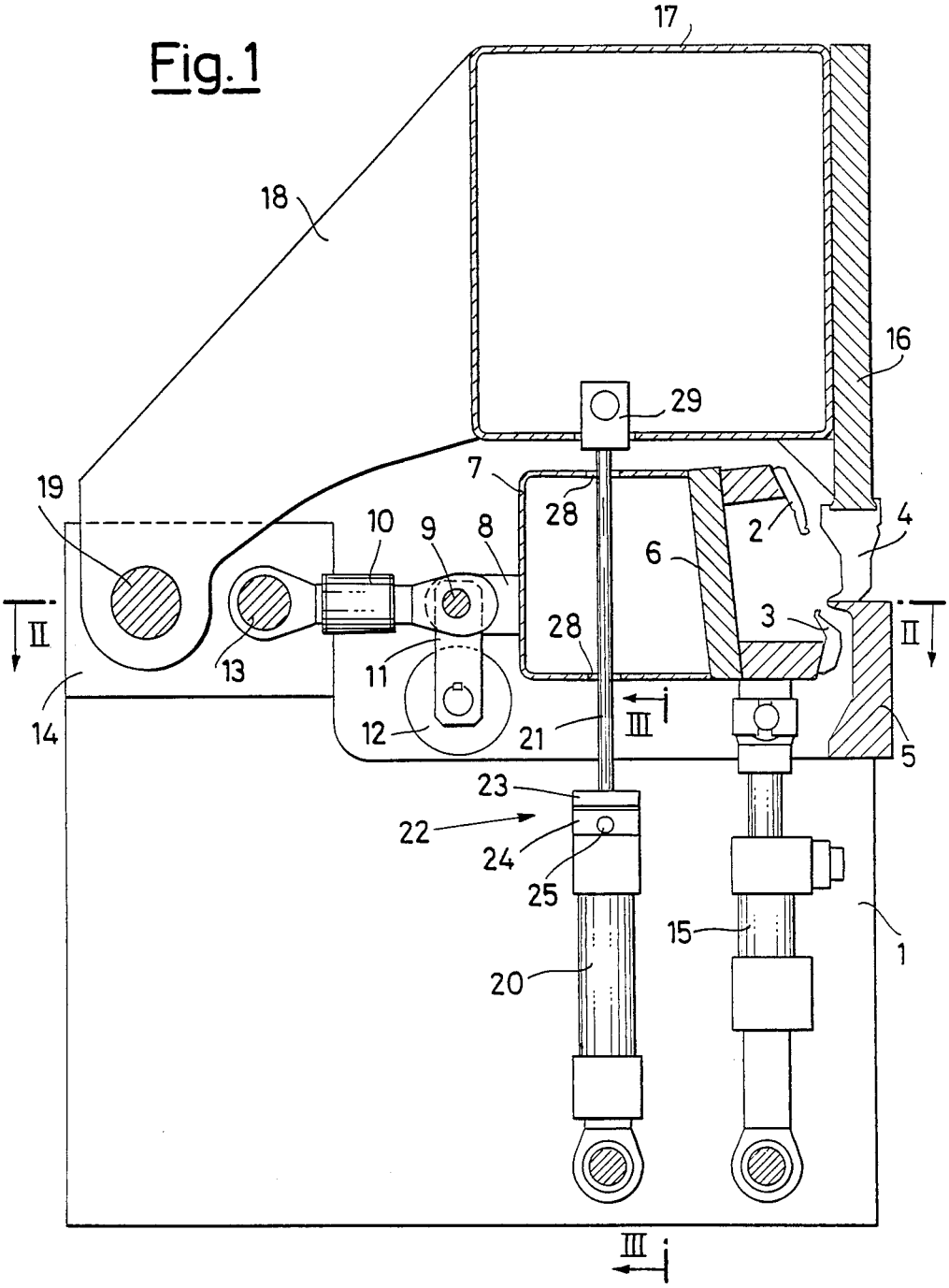
FIG. 1 shows a bending machine for sheet metal panels according to the invention, in a section along the line I—I in FIG. 2.
Figure 2:
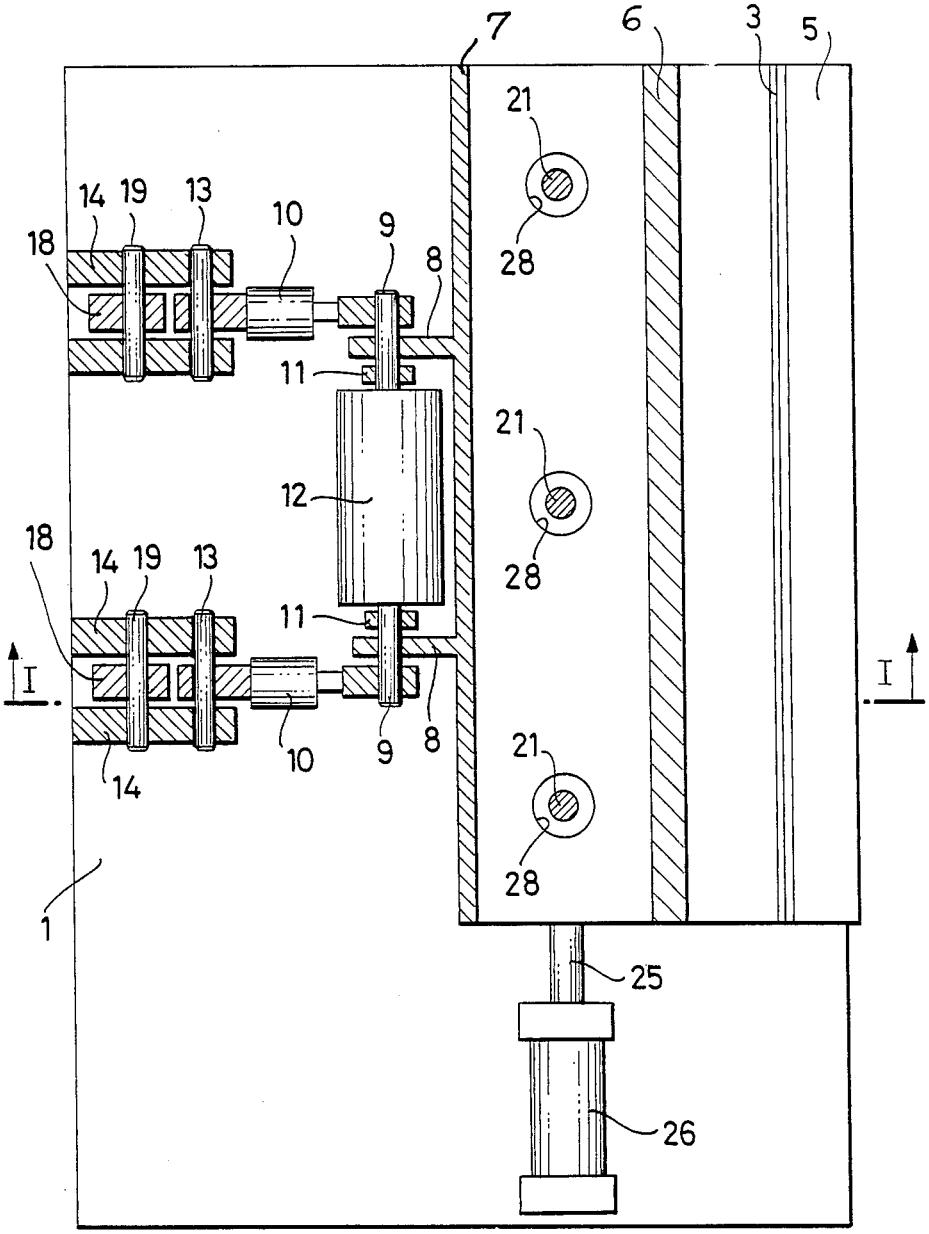
FIG. 2 shows the above machine in a section along the line II—II in FIG. 1.

With reference to FIGS. 1 and 2, a bending machine is shown with a fixed base 1 comprising a counterblade 5 for supporting the sheet metal panel to be bent, a blank holder 4 and a pair of opposite blades 2 and 3.

The two blades 2 and 3 are fixed to a C-shaped element 6 connected by means of an intermediate boxed support 7 to arms 8 rotating on pivots 9, which also connect one end of hydraulic cylinders 10 and of levers 11 fixed to a torsion bar 12. The hydraulic cylinders 10, which provide the horizontal translation of the blades 2 and 3, are supported by pivots 13 rotating in brackets 14 of the fixed base 1.

The C-shaped element 6 is connected in the lower part to further vertical hydraulic cylinders 15 which produce the vertical translation of the blades 2 and 3 and which are hinged in the lower part of the base 1.

As shown in FIG. 1, the blank holder 4 is integral with a plate 16 fixed by means of an intermediate boxed support 17 to arms 18 projecting inside the boxed element 17 fixed to the plate 16 and which are hinged in 19 to said brackets 14 of the base 1. The blank holder 4 is induced to rotate about the pivot 19 by means of hydraulic cylinders 20, whose stems 21 pass through the opening 28 of the boxed support 7 for the blades 2 and 3. Said stems 21 have their upper ends 29 connected to the arms 18 inside the boxed element 17 supporting the blank holder 4.

Said hydraulic cylinders 20 are supported in a rotatable way in the lower part of the base 1 and exert a downward force on the blank holder 4, which is distributed along the longitudinal extension of the boxed element 17.

The hydraulic cylinders 20 are connected to a stoppage system having stoppage means 22 of the stroke of the stems 21 so that the stop of the blank holder 4 is obtained in a position which is above the sheet metal panel positioned over the underlying counterblade 5. This stoppage condition is necessary for executing bends that are so-called 'safe hands' uncrushed U-shaped bends on the edges of a sheet.

Such stoppage means 22 comprises a pair of wedges 23 and 24 associated with each hydraulic cylinder 20, in which the upper wedge 23 is integral with the stem 21 of the corresponding hydraulic cylinder 20 and the lower wedge 24 is integral with all the other lower wedges 24 by means of successive portions of a rod 25 operated by a hydraulic cylinder 26.

Figure 3:
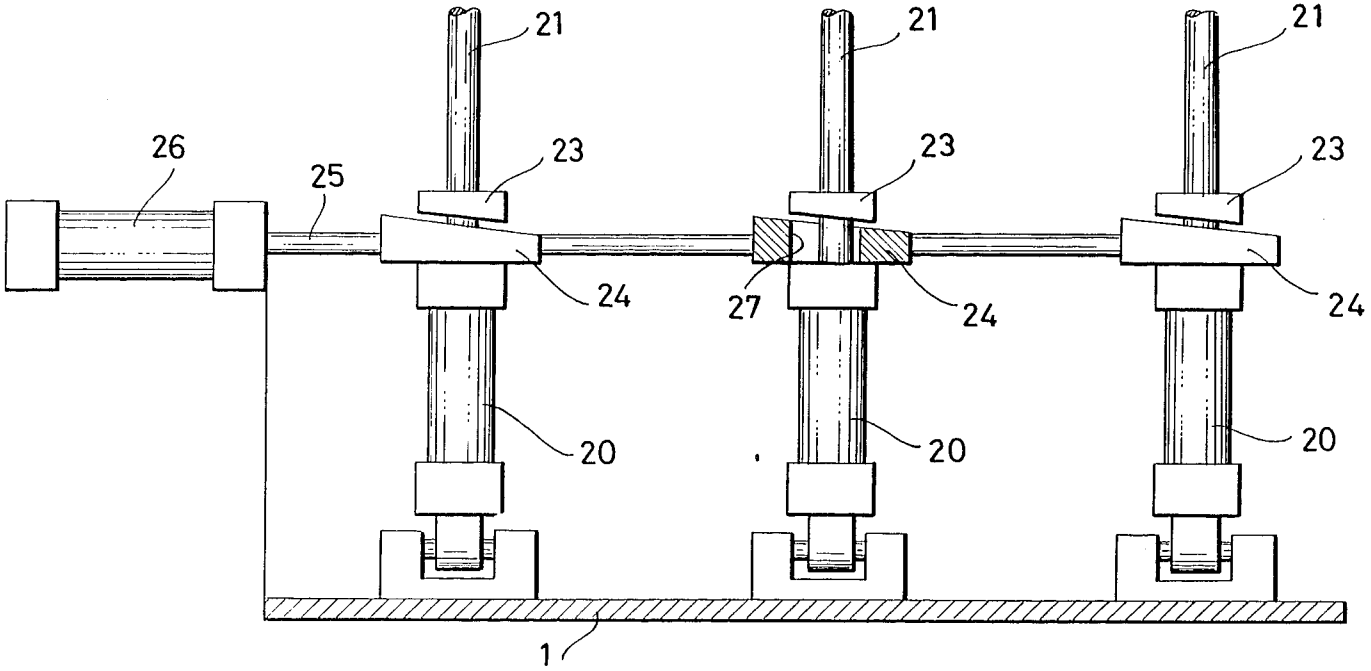
FIG. 3 shows the above machine in a schematic section along the line III—III in FIG. 1.

FIG. 3 illustrates the function of wedges 23 and 24 of stopping means 22. Each wedge 24 has a central aperture 27 for the passage of the stem 21 and such aperture 27 has an extension sufficient to permit a certain translation of wedge 24 in a longitudinal direction parallel to the blank holder 4 using as a sliding guide the upper end of the hydraulic cylinder 20. Horizontal cylinder 26 moves rod 25 in the longitudinal direction. Wedges 24 are connected to rod 25, so that any movement in rod 25 caused by horizontal cylinder 24 causes wedges 24 also to move.

Given a preselected position of the lower wedges 24, a stoppage position of the stems 21 of the cylinders 26 is obtained, corresponding to a stoppage position of the blank holder 4.

The operation of the bending machine described is as follows.

Starting from the position shown in FIG. 1, since the edges of a sheet metal panel are to be bent, the blank holder 4 is raised through its rotation by means of the hydraulic cylinders 20 on the pivots 19 of the arms 18. A sheet metal panel is then positioned on the counterblade 5 so that the part of the panel to be bent protrudes from the edge of the counterblade, towards the inside of the machine. The blank holder 4 is then lowered onto the panel, pressing it in a uniform manner against the counterblade 5, if necessary modulating the pressure exerted by the hydraulic cylinders 20 in an appropriate manner.

At this point, by means of the vertical 15 and horizontal 10 cylinders one of the two blades 2 and 3 is pushed up against the edge of the panel and the required bend is obtained.

If a U-shaped bend is required, a so-called "safe hands" uncrushed U-shaped bend, it will be the lower blade 3 to operate first from the bottom up and thus produce a partial bend. The blank holder 4 is then raised again and the sheet metal panel will be positioned slightly further back on the counterblade; at the same time the downward stroke of the blank holder 4 is adjusted by moving the wedges 24 so that the stems 21 are stopped, by coupling with the corresponding upper wedges 23, so as to stop the downward movement of the blank holder in a position above the sheet metal panel. The hydraulic cylinders which lower the blank holder 4 are then operated again, the blank holder pushes against the previously-obtained partial bend, producing a so-called "safe hands" uncrushed U-shaped bend which is uniform along the entire side of the panel thanks to the wedged stoppage system and to the uniform distribution of the force along the entire edge of the sheet metal panel.

If conventional-type bends are required, in which it is not necessary to stop the blank holder in a higher position, the wedges 24 are arranged in a rest position in which there is no connection with the wedges 23 when the blank holder is lowered onto the counterblade 5.

I claim:

1. A bending machine comprising:

a fixed base with a counterblade;

a movable support having a first and second end, said first end being rotatably attached to the fixed base about a hinge;

a blank holder extending along a first direction, said blank holder being attached to said second end of said support and being movable with said support about said hinge to clamp a workpiece between said counterblade and said blank holder;

a plurality of hydraulic cylinders, disposed parallel to said first direction and mounted on said fixed base, for moving about said hinge said support toward and away from said base, each of said hydraulic cylinders having a stem connected to said movable support;

a common support having openings to allow said plurality of stems to freely pass through said common support;

a pair of opposite blades connected to said common support, each blade being mounted to bend said workpiece located between said counterblade and said blank holder; and means for moving said common support and pair of blades relative to said base.

2. A bending machine comprising:

a fixed base with a counterblade;

a movable support having a first and second end, said first end being rotatably attached to the fixed base about a hinge;

a blank holder extending along a first direction, said blank holder being attached to said second end of said support and being movable with said support about said hinge to clamp a workpiece between said counterblade and said blank holder;

a plurality of hydraulic cylinders, disposed parallel to said first direction, for moving about said hinge said support toward and away from said base;

a pair of opposite blades, each blade being mounted to bend said workpiece located between said counterblade and said blank holder; and means for moving said pair of blades relative to said base, said moving means comprising horizontal and vertical cylinders, said horizontal and vertical cylinders moving said pair of blades relative to said base, said horizontal and vertical orientation of said cylinders being defined by the direction in which said cylinders operate.

3. Bending machine according to claim 2, wherein said horizontal hydraulic cylinders are connected to said blades by means of pivots which are also connected with levers rigidly connected to a torsion bar.

4. A bending machine comprising:

a fixed base with a counterblade;

a movable support having a first and second end, said first end being rotatably attached to the fixed base about a hinge;

a blank holder extending along a first direction, said blank holder being attached to said second end of said support and being movable with said support about said hinge to clamp a workpiece between said counterblade and said blank holder;

a plurality of hydraulic cylinders, disposed parallel to said first direction, for moving about said hinge said support toward and away from said base;

stopping means operated separately from said hydraulic cylinders for stopping said blank holder in a position above said counterblade;

a pair of opposite blades, each blade being mounted to bend said workpiece located between said counterblade and said blank holder; and means for moving said pair of blades relative to said base.

5. Bending machine according to claim 4, wherein said stoppage means comprises a plurality of wedges associated with each of said hydraulic cylinders so as to limit said movement of said movable support toward said fixed base, thereby limiting said movement of the blank holder.

6. Machine according to claim 5, wherein said wedges comprise movable elements connected to one another and to the stem of a further hydraulic cylinder operating in a horizontal direction.

* * * * *